US007474183B2

(12) United States Patent
Smith

(10) Patent No.: US 7,474,183 B2
(45) Date of Patent: Jan. 6, 2009

(54) SYSTEM AND METHOD FOR LATCHING MAGNETIC OPERATOR DEVICE

(75) Inventor: Richard G. Smith, North Aurora, IL (US)

(73) Assignee: Siemnes Energy & Automation, Inc., Alpharetta, GA (US)

( * ) Notice: Subject to any disclaimer, the term of this patent is extended or adjusted under 35 U.S.C. 154(b) by 655 days.

(21) Appl. No.: 09/961,859

(22) Filed: Sep. 24, 2001

(65) Prior Publication Data

US 2003/0058070 A1 Mar. 27, 2003

(51) Int. Cl.
*H01H 67/02* (2006.01)

(52) U.S. Cl. ..... 335/132; 361/192

(58) Field of Classification Search ..... 335/132, 335/128–131; 361/192
See application file for complete search history.

(56) References Cited

U.S. PATENT DOCUMENTS 3,569,890 A * 3/1971 Baratelli ..... 335/170
3,599,133 A * 8/1971 Richert ..... 335/230
3,851,286 A * 11/1974 McClurg et al. ..... 335/273
3,914,723 A * 10/1975 Goodbar ..... 335/79
3,950,718 A * 4/1976 Nagamoto ..... 335/79
4,675,776 A * 6/1987 Howell ..... 361/92
5,488,340 A * 1/1996 Maley et al. ..... 335/253

FOREIGN PATENT DOCUMENTS

EP 1061650 A1 * 12/2000
GB 2098400 A * 11/1982

* cited by examiner

*Primary Examiner*—Elvin G Enad
*Assistant Examiner*—Bernard Rojas

(57) ABSTRACT

A latching electromagnetically actuable device comprises an electromagnet and an electrical coil. The electromagnet comprises an armature and a core. At least one of the armature and the core is of a magnetically hard material. A housing supports the electromagnet and the coil. Energizing the coil in a first direction magnetizes the magnetically hard material to draw the armature and core together and latch the electromagnet. Energizing the coil is a second direction releases the electromagnet.

21 Claims, 2 Drawing Sheets

SYSTEM AND METHOD FOR LATCHING MAGNETIC OPERATOR DEVICE

TECHNICAL FIELD OF THE INVENTION

This invention relates to an electromagnetically actuable device and, more particularly, to a latching magnetic operator.

BACKGROUND OF THE INVENTION

A conventional electromagnetically actuable device has a magnetic core proximate an armature. Typically, a coil is selectively energized to draw the armature to the magnetic core. The device may be a solenoid, a contactor, a relay, a motor starter, or the like. The armature is operatively associated with a movable operator such as movable contacts or an actuator. In many instances the coil is selectively energized from an AC power source. With AC-operated electromagnetics, elimination or control of noise is a prime concern. Also, it is desirable to minimize operating costs such as for electric power.

Devices such as control relays, motor starters or contactors may be actuated for extended periods of time. This can be done by wiring a hold-in contact associated with the operator in parallel with a user input device. When the user input device is actuated, the coil is energized. This causes the hold in contact to close to maintain the electromagnetically actuable device in its actuated state. The user input device need not remain actuated. However, electrical power continues to be delivered to the coil. To minimize noise the surface interface of the magnetic core and armature of each device must be matched to provide minimal magnetic "air gap" in a stable interface surface. The minimal air gap assures sufficient force to prevent movement and the stable interface surface prevents movements due to the widely changing forces in the AC-operated device. Particularly, a return spring provides a constant force between the magnetic core and the armature. Energization of the coil counteracts the spring force to draw the armature toward the magnetic core. However, with an AC power source operating at, for example, 60 hertz, there are 120 zero crossings each second during energization. At each zero crossing the spring force may overcome the magnetic force causing the armature to be pushed away and then drawn back again. This can produce "chattering" resulting in a noisy electromagnet.

A conventional latching magnetic operator uses a permanent magnet for the armature and the core. However, permanent magnets can be expensive and can also present difficulties in manufacturing environments. Particularly, permanent magnets may be brittle and can cause handling problems. The electrical coil may be used to actuate the device with a relatively short duration pulse. Thereafter, the permanent magnet provides latching. A reverse polarity pulse can be applied to the coil to release the electromagnet. The level of the reverse pulse must be limited to prevent a latched state with opposite polarity. Because a permanent magnet relay can also be mechanically latched or unlatched, vibration can cause the relay to latch by pulling the electromagnet shut.

SUMMARY OF THE INVENTION

In accordance with the invention, a latching magnetic operator device uses an electromagnet of a magnetically hard material.

Broadly, there is disclosed herein a latching electromagnetically actuable device comprising an electromagnet and an electrical coil. The electromagnet comprises an armature and a core. At least one of the armature and the core is of a magnetically hard material. A housing supports the electromagnet and the coil. Energizing the coil in a first direction magnetizes the magnetically hard material to draw the armature and core together and latch the electromagnet. Energizing the coil in a second direction releases the electromagnet.

It is a feature of the invention that the at least one of the armature and the core is of a high residual material such as tool steel.

It is another feature of the invention that the coil comprises a main winding and a release winding with opposite polarity and wherein energizing the coil in the first direction energizes the main winding and energizing the coil in the second direction energizes the release winding with opposite polarity to remove the residual magnetism to unlatch or release the device.

It is yet another feature of the invention to provide a control circuit having a first input and an second input and a current limit device connected to the second input, whereby the electromagnet is latched responsive to the first input being energized and released responsive to the second input being energized. The control circuit comprises a rectifier circuit to control polarity of power supply to the coil to latch or release the electromagnet.

It is still another feature of the invention that at least one of the armature and the core comprises a solid block of magnetically hard material.

There is disclosure in accordance with another aspect of the invention a latching magnetic operator device comprising an electromagnet and an electrical coil. The electromagnet comprises an armature and a core of magnetically hard material. A housing fixedly supports the core and the coil and movably supports the armature approximate the core. Energizing the coil in a first direction magnetizes the magnetically hard material to draw the armature and core together and latch the electromagnet. Energizing the coil in a second direction releases the electromagnet. A control circuit is connected to the coil to selectively latch the electromagnet with high residual magnetism and release the electromagnet be reducing the residual magnetism.

There is disclosed in accordance with yet another aspect of the invention a latching magnetically actuable electrical contact device comprises an electromagnet and an electrical coil. The electromagnet comprises an armature and a core of a magnetically hard material. A housing supports the electromagnet and the coil. Energizing the coil in a first direction magnetizes the magnetically hard material to draw the armature and core together and latch the electromagnet. Energizing the coil in a second direction releases the electromagnet. An electrical contact operator in the housing is selectively actuated responsive to latching or releasing of the electromagnet.

Further features and advantages of the invention will be readily apparent from the specification and the drawings.

DETAILED DESCRIPTION OF THE INVENTION

Figure 1:
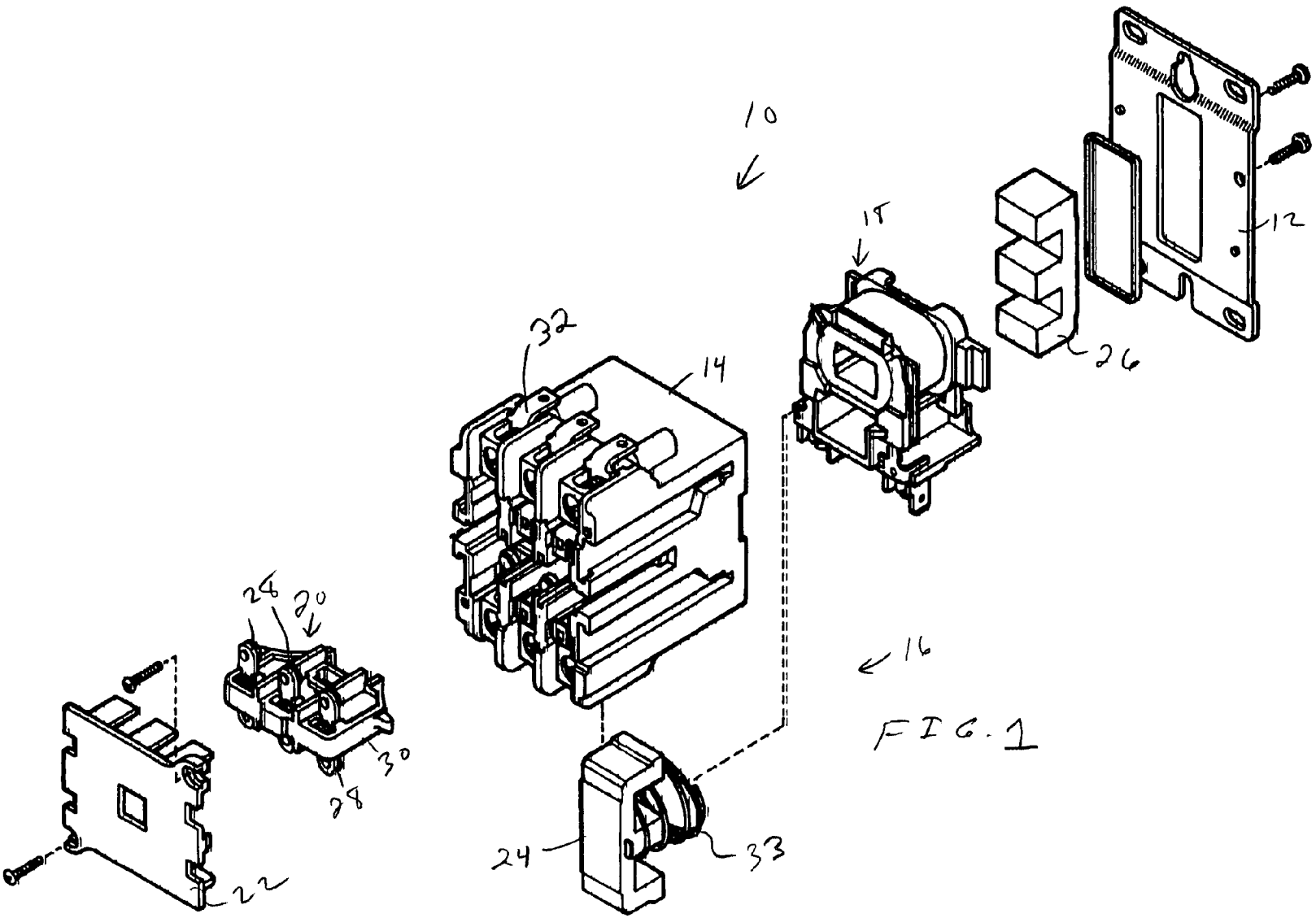
FIG. 1 is an exploded, perspective view of an electromagnetically actuable device in the form of a contactor including a latching magnetic operator in accordance with the invention.

Referring initially to FIG. 1, an electromagnet magnetically actuable device in the form of an electrical contactor 10 is illustrated in exploded form. The contactor 10 includes a base 12, a housing 14, an electromagnet 16, a coil 18, an operator 20 and a cover plate 22. The electromagnet 16 includes an armature 24 and a core 26. The housing 14 is mounted to the base 12 and encloses the coil 18 and the core 26. The coil 18 is fixedly mounted in the housing 14. Likewise, the core 26 is fixedly mounted in the housing 14 and is generally "E" shaped and is received in the coil 18 in a conventional manner. The coil 18 includes conventional bobbin, winding and terminal assembly. The armature 24 is mechanically linked with the operator 20 in a conventional manner. The operator 20 comprises a contact carrier 30 supporting movable contacts 28. Particularly, the contact carrier 30 moves with the armature 24. The housing 14 also supports stationary contacts 32 positioned in proximity with the movable contacts 28.

A return spring 33 is disposed between the armature 24 and the coil 18. The return spring 33 biases the armature 24 away from the core 26. When the coil 18 is energized, the movable armature 24 is drawn toward the core 26 in a conventional manner. The movement of the armature 24 and thus the operator 20 toward the core 26 causes the movable contacts 28 to selectively open or close an electrical circuit with the stationary contacts 32, as is known.

While this application illustrates an electromagnetically actuable device in the form of a contactor, the teachings of the invention can similarly be applied to other electromagnetically actuable devices such as AC solenoids, electromagnetic actuators, motor starters, control relays, or the like. Each such device includes an operator designed according to its intended function.

In accordance with the invention, at least one or both of the armature 24 and core 26 is formed of a high residual magnetically hard material such as tool steel. As is known, tool steel comprises a high carbon steel. As is also known, a magnetically hard material retains much of its induced magnetism when a magnetizing field is removed. This creates temporary magnetic properties in the electromagnet 16 in the presence of an external magnetic field produced by energization of the coil 18.

In its most common form, the electrical coil 18 includes a single winding. Thus, current in one direction in the winding of the coil 18 magnetizes the high residual material of the electromagnet 16. Once the magnetic force overcomes force of the return spring 33, the armature 24 is drawn to the core 26 to actuate the operator 20. The operator 20 remains engaged or "latched" by residual flux in the electromagnet 16 with no coil power. Current through the winding in the opposite direction releases the device and must be limited to not fully remagnetize the magnetically hard material in the opposite polarity as doing so would not release the operator 20.

Figure 2:
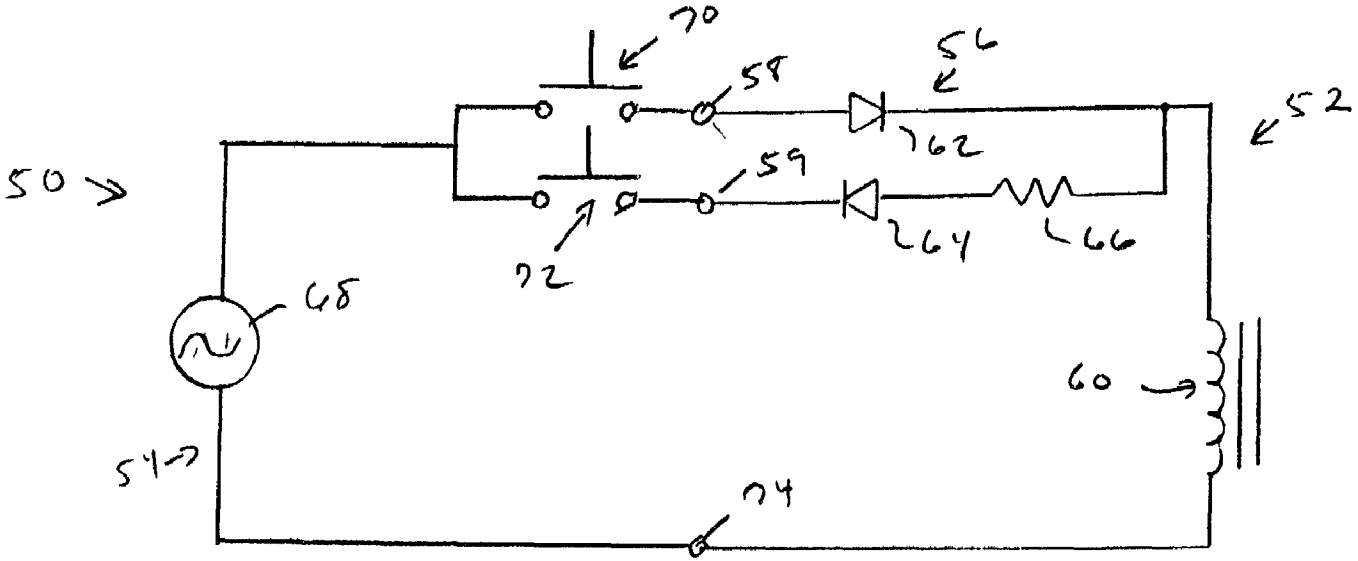
FIG. 2 is an electrical schematic of a control system including a control circuit of the device of FIG. 1 in accordance with a first embodiment of the invention.

Referring to FIG. 2, an electrical schematic illustrates a control system 50 used with one embodiment of the contactor of FIG. 1. Particularly, the control system 50 includes a contactor control circuit 52 integrated into the electrical coil 18 of FIG. 1 and an external circuit 54. The control circuit 52 includes a half-wave rectifier circuit 56 connected between terminals 58 and 59 and a winding 60 of the coil 18. The rectifier 56 includes a forward biased diode 62 connected to the first terminal 58 and a reverse biased diode 64 connected to the second terminal. A resistor 66 is connected in series with the reverse biased diode 64.

The external circuit includes an AC supply 68, a first push button 70 and a second push button 72. The first push button 70 is connected between the supply 68 and the first terminal 58. The second push button 72 is connected between the supply 68 and the second terminal 59. The opposite side of the supply 68 is connected via a third terminal 74 to the opposite side of the winding 60.

In operation of the control system 50, and starting at a rest state, when the first push button 70 is depressed, current in a first direction is provided to the winding 60 to energize the coil 18 in a first direction representing positive polarity to actuate the electromagnet 16 and operator 20, as discussed above, causing the contacts 28 and 32 to close. When the first push button 70 is released, the electromagnet 16 and the operator 20 remain latched. Thereafter, depressing the second push button 72 provides current in the opposite direction through the winding 60 to energize the coil 18 in a second, or opposite, direction to release the electromagnet 16. In accordance with the invention, the resistor 66 limits current during the release operation so that the electromagnet 16 is not fully remagnetized in the opposite polarity.

It will be appreciated by one of ordinary skill in the art that other, more complex, circuits may be used which emulate the typical relay/actuator function without the sustained wattage requirements. Additional logic, sensing and control schemes may also be used, as will also be apparent.

Figure 3:
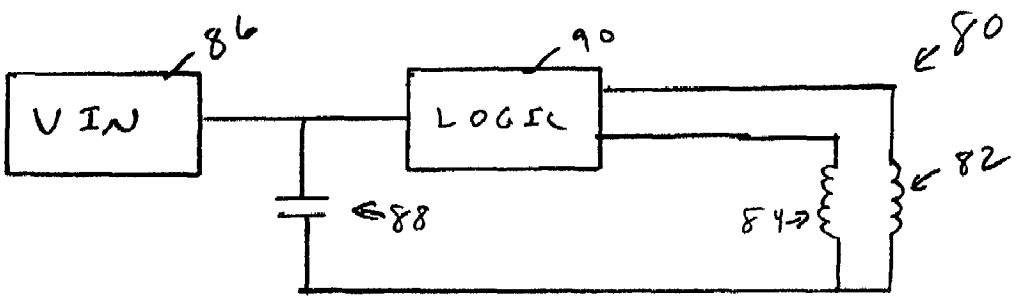
FIG. 3 is an electrical schematic of a control system including a control circuit of the device of FIG. 1 in accordance with a second embodiment of the invention

Referring to FIG. 3, an electrical schematic illustrates a control system 80 according to an alternative embodiment of the invention. In this embodiment, the coil 18 includes a main winding 82 and an opposite polarity release winding 84. A voltage in, VIN, supply 86 is connected to a capacitor 88 and a logic circuit 90. The logic circuit 90 is connected to the windings 82 and 84. The logic circuit 90 latches the electromagnet 16, see FIG. 1, by using a "dump" of the voltage from the capacitor 88. The residual magnetism maintains the electromagnet 16 latched. No wattage is required for the coil 18. To remain in the "maintain" or "on" state, the logic circuit 90 monitors the input voltage and keeps a charge on the capacitor 88. When the voltage input drops into a defined "off" condition, the logic circuit 90 dumps the voltage from the capacitor 88 across the release winding 84 and the residual magnetism is dropped down to a release level. The device opens normally like any other contactor.

It will be appreciated by one of ordinary skill in the art that the release winding could be eliminated and reverse polarity power could be provided through the main winding, as with the embodiment of FIG. 2.

In the illustrated embodiment of the invention, the electromagnet 16 does not require laminations. Instead, the armature 24 and/or core 26 are formed of solid blocks of magnetically hard material. The magnetic gaps are kept to a minimum and the residual material may be full-hard tool steel. This results in a solid latching, quiet contactor device.

It can therefore be appreciated that a new and novel system and method for a latching magnetic operator device has been described. It will be appreciated by those skilled in the art that, given the teaching herein, numerous alternatives and equivalents will be seen to exist which incorporate the disclosed invention. As a result, the invention is not to be limited by the foregoing exemplary embodiments, but only by the following claims.

I claim:

1. A latching electromagnetically actuable device comprising:

an electromagnet comprising an armature and a core, at least one of the armature and the core being of a magnetically hard material;

an electrical coil;

a housing supporting the electromagnet and the coil, wherein energizing the coil in a first direction magnetizes the magnetically hard material to draw the armature and core together and latch the electromagnet, and energizing the coil in a second direction releases the electromagnet; and a control circuit having a first input and a second input and a current limit device connected to the second input, whereby the electromagnet is latched responsive to the first input being energized and released responsive to the second input being energized, the current limit device limiting release current relative to latch current so the electromagnet is not remagnetized when it is released.

2. The latching electromagnetically actuable device of claim 1 wherein the at least one of the armature and the core is of a high residual material.

3. The latching electromagnetically actuable device of claim 1 wherein the at least one of the armature and the core is of tool steel.

4. The latching electromagnetically actuable device of claim 1 wherein the coil comprises a main winding and a release winding and wherein energizing the coil in the first direction energizes the first winding, and energizing the coil in the second direction energizes the second winding.

5. The latching electromagnetically actuable device of claim 1 wherein the control circuit comprises a rectifier circuit to control polarity of power supplied to the coil to latch or release the electromagnet.

6. The latching electromagnetically actuable device of claim 1 wherein the at least one of the armature and the core comprises a solid block of magnetically hard material.

7. A latching magnetic operator device comprising:

an electromagnet comprising an armature and a core, the armature and the core being of a magnetically hard material;

an electrical coil;

a housing fixedly supporting the core and the coil and moveably supporting the armature proximate the core, wherein energizing the coil in a first direction magnetizes the magnetically hard material to draw the armature and core together and latch the electromagnet, and energizing the coil in a second direction releases the electromagnet; and a control circuit connected to the coil to selectively latch the electromagnet with high residual magnetism and release the electromagnet with low residual magnetism, wherein the control circuit has a first input and a second input and a current limit device connected to the second input, whereby the electromagnet is latched responsive to the first input being energized and released responsive to the second input being energized, the current limit device limiting release current relative to latch current to provide the low residual magnetism.

8. The latching magnetic operator device of claim 7 wherein the armature and the core are of a high residual material.

9. The latching magnetic operator device of claim 7 wherein the armature and the core are of tool steel.

10. The latching magnetic operator device of claim 7 wherein the coil comprises a main winding and a release winding and wherein energizing the coil in the first direction energizes the first winding, and energizing the coil in the second direction energizes the second winding.

11. The latching magnetic operator device of claim 7 wherein the control circuit comprises a rectifier circuit to control polarity of power supplied to the coil to latch or release the electromagnet.

12. The latching magnetic operator device of claim 7 wherein the armature and the core each comprises a solid block of magnetically hard material.

13. A latching magnetically actuable electrical contact device comprising:

an electromagnet comprising an armature and a core, the armature and the core being of a magnetically hard material;

an electrical coil;

a housing supporting the electromagnet and the coil, wherein energizing the coil in a first direction magnetizes the magnetically hard material to draw the armature and core together and latch the electromagnet, and energizing the coil in a second direction releases the electromagnet;

a control circuit having a first input and a second input and a current limit device connected to the second input, whereby the electromagnet is latched responsive to the first input being energized and released responsive to the second input being energized, the current limit device limiting release current relative to latch current so the electromagnet is not remagnetized when it is released; and an electrical contact operator in the housing selectively actuated responsive to latching or releasing of the electromagnet.

14. The latching magnetically actuable electrical contact device of claim 13 wherein the armature and the core are of a high residual material.

15. The latching magnetically actuable electrical contact device of claim 13 wherein the armature and the core are of tool steel.

16. The latching magnetically actuable electrical contact device of claim 13 wherein the coil comprises a main winding and a release winding and wherein energizing the coil in the first direction energizes the first winding, and energizing the coil in the second direction energizes the second winding.

17. The latching magnetically actuable electrical contact device of claim 13 wherein the control circuit comprises a rectifier circuit to control polarity of power supplied to the coil to latch or release the electromagnet.

18. The latching magnetically actuable electrical contact device of claim 13 wherein the armature and the core each comprises a solid block of magnetically hard material.

19. The method of latching an electromagnetically actuable device comprising:

providing an electromagnet comprising an armature and a core, at least one of the armature and the core being of a magnetically hard material, an electrical coil, a control circuit having a first input and a second input and a current limit device connected to the second input, and a housing supporting the electromagnet and the coil;

energizing the coil in a first direction to magnetize the magnetically hard material to draw the armature and core together and latch the electromagnet; and energizing the coil in a second direction to release the electromagnet, the current limit device limiting release current relative to latch current so the electromagnet is not remagnetized when it is released.

20. The method of claim 19 wherein providing an electromagnet comprises at least one of the armature and the core being of a high residual material.

21. The method of claim 19 wherein providing an electromagnet comprises at least one of the armature and the core being of tool steel.

* * * * *